US005226653A

United States Patent [19]

Bil et al.

[11] Patent Number: 5,226,653

[45] Date of Patent: Jul. 13, 1993

[54] MULTILEVEL PLAY FEATURE FOR A PINBALL GAME

[75] Inventors: Zofia Bil, Chicago; Bill Pfutzenreuter, Arlington Hts.; Barry Oursler, Barrington, all of Ill.

[73] Assignee: Williams Electronics Games, Inc., Chicago, Ill.

[21] Appl. No.: 906,523

[22] Filed: Jun. 30, 1992

[51] Int. Cl.[5] ..... A63F 7/02; A63F 7/30

[52] U.S. Cl. ..... 273/121 A; 273/177 R; 273/177 C; 273/118 A; 273/118 D; 273/119 A

[58] Field of Search ..... 273/118 R, 118 A, 119 R, 273/119 A, 120 R, 120 A, 121 R, 121 A, 121 D, 121 E, 122 R, 122 A, 123 R, 123 R, 124 R, 124 A, 125 R, 125 A, 127 R, 127 A, 127 B, 127 C, 127 D, 129 R, 129 S

[56] References Cited

U.S. PATENT DOCUMENTS 4,243,222 1/1981 Grabel et al. .
4,257,604 3/1981 Grabel et al. .
4,426,081 1/1984 Fainzilberg ..... 273/127 D
4,773,646 9/1988 Joos, Jr. et al. ..... 273/121 A
4,840,375 6/1989 Lawlor et al. ..... 272/121 A
4,934,699 6/1990 Yaminkow et al. ..... 273/121 A
4,943,061 7/1990 Grabel .

*Primary Examiner*—V. Millin
*Assistant Examiner*—Raleigh W. Chiu
*Attorney, Agent, or Firm*—Rockey, Rifkin and Ryther

[57] ABSTRACT

The play feature of the invention consists of a three level target assembly where the uppermost level is mounted on a section of the playfield. The two lower levels are mounted to the underside of the playfield section such that upon activation of the play feature's drive system, the playfield section is raised to sequentially expose the two lower levels. In the preferred embodiment, the upper level includes ball ejector holes, the middle level includes button targets and the lower level includes ball diverting chutes. The game's microprocessor can be programmed to allow the ball ejector holes to eject the trapped ball only after the player completes a predetermined series of shots using a second ball. In such a situation, the ejection of the trapped ball will result in multi-ball play where more than one ball is in play at the same time.

9 Claims, 4 Drawing Sheets

FIG. 1
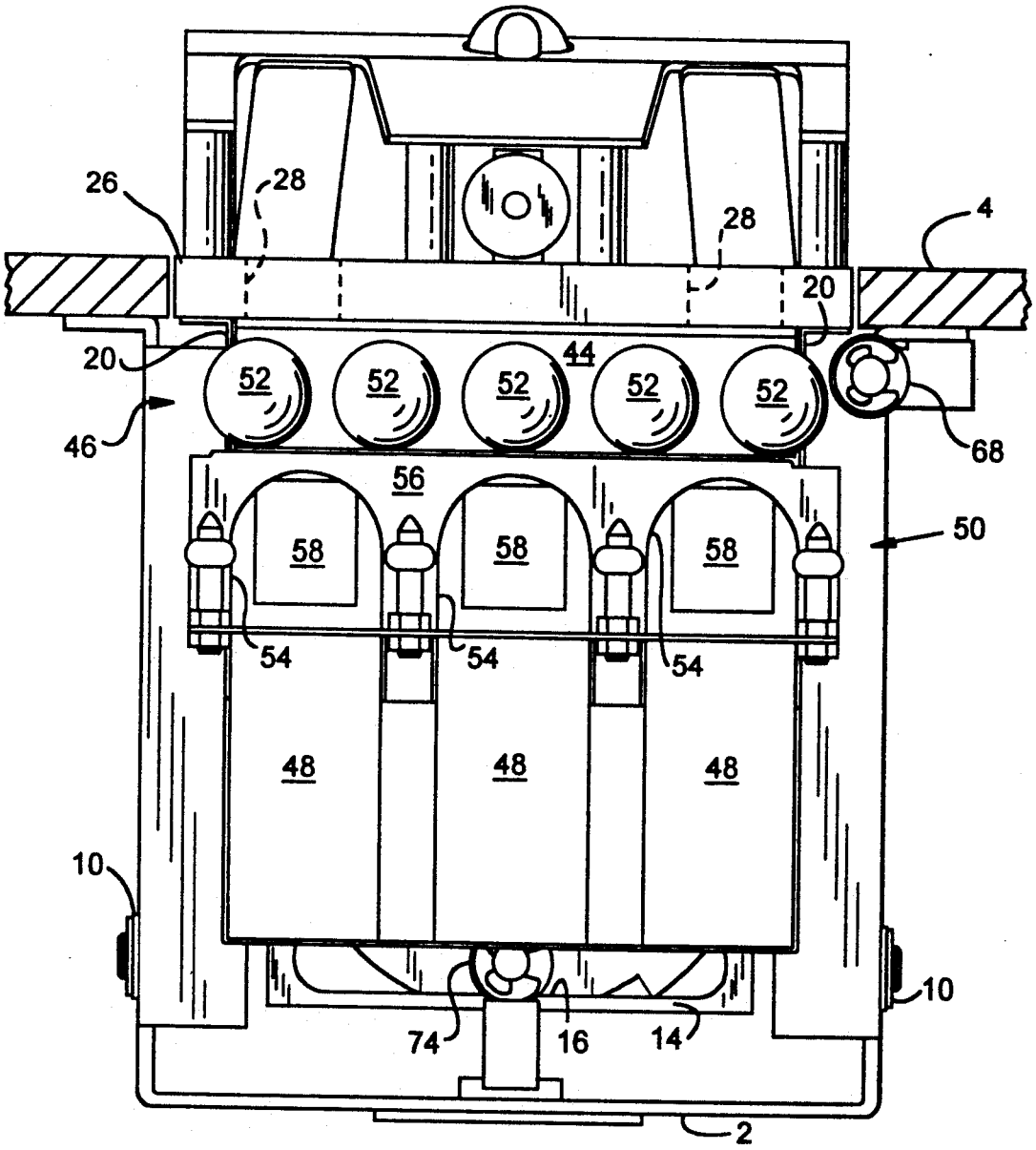
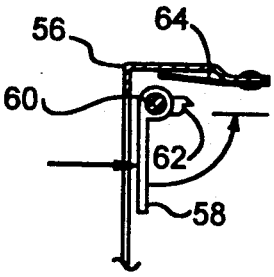
FIG. 3
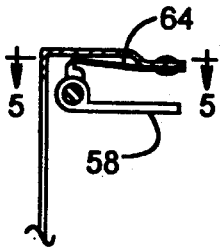
FIG. 4
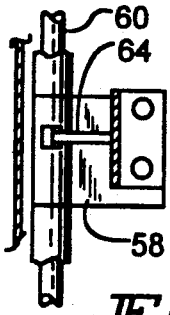
FIG. 5

MULTILEVEL PLAY FEATURE FOR A PINBALL GAME

SUMMARY OF THE INVENTION

The play feature of the invention consists of a three level assembly mounted to the playfield. The upper level is flush with the playfield. The two lower levels are located below the playfield until activation of a motor drive system, which sequentially rotates each level to expose them to play. In the preferred embodiment, the upper level includes one or more ball ejector holes; The middle or second level includes button targets while the lower level includes ball diverting chutes. The game's microprocessor can be programmed to allow the ball ejector holes to eject a first, trapped ball only after the player completes a predetermined series of shots using a second ball. In such a situation, the ejection of the trapped ball will result in multi-ball play where more than one ball is in play at the same time.

BRIEF DESCRIPTION OF THE DRAWINGS

FIG. 1 is a front view of the play feature of the invention.

FIGS. 3 through 5 are detailed views of the gate structure of the play feature of the invention.

DETAILED DESCRIPTION OF THE INVENTION

Figure 6:
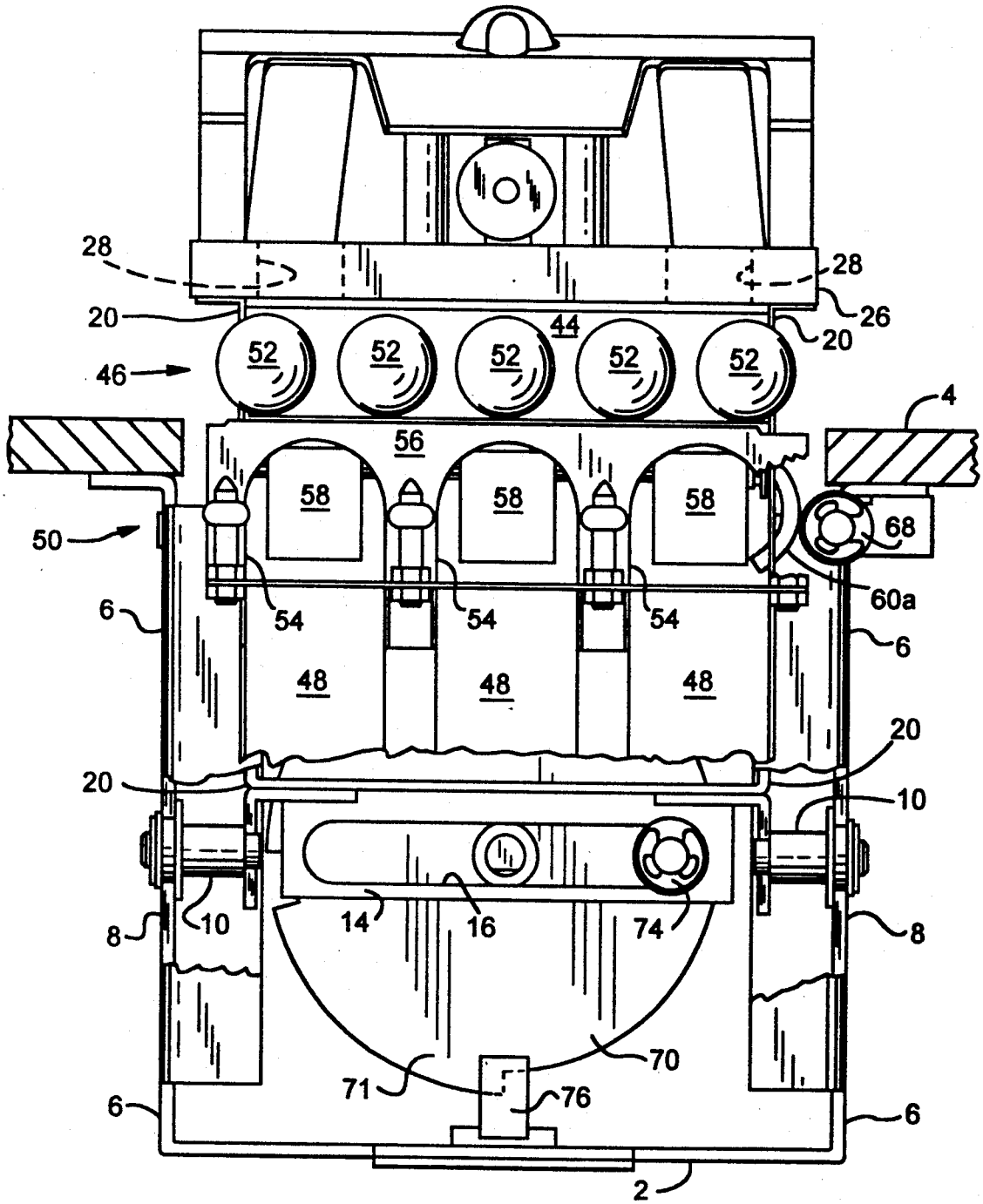
FIG. 6 is a partially cut-way front view showing the play feature of the invention in its middle position.

Referring more particularly to the Figures, the play feature of the invention consists of a substantially U-shaped support bracket 2 mounted to the underside of playfield 4. The vertical legs 6 of bracket 2 include vertically extending slots 8 as best shown in FIG. 6. Slidably mounted in each of slots 8 are bearings 10 supporting cam plate 14 therebetween.

Figure 2:
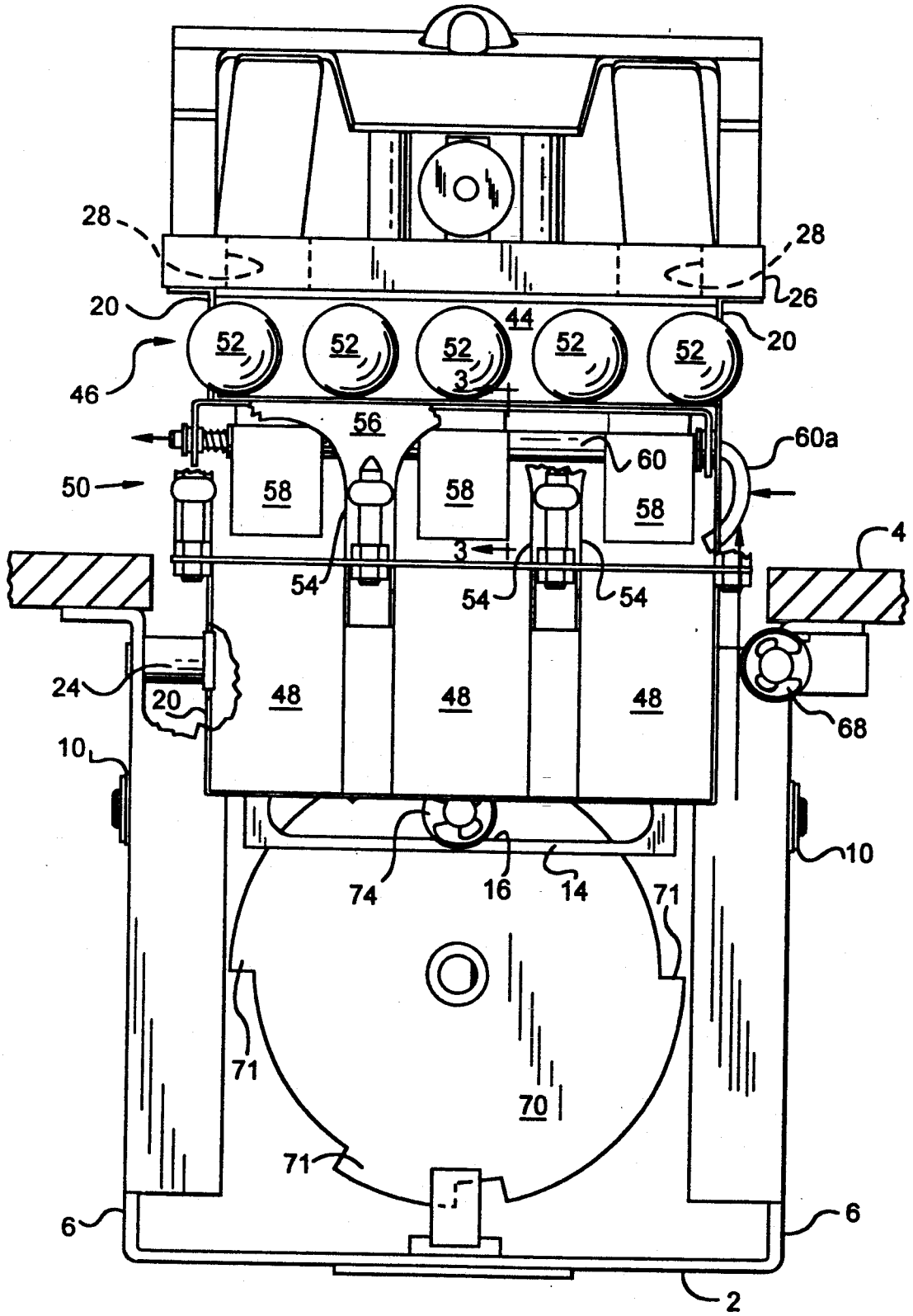
FIG. 2 is a front view showing the play feature in its elevated position.

Cam plate 14 includes a horizontally extending slot 16 that acts as a cam follower to receive the cam finger 74 of drive system 18 a will be hereinafter described. Vertical members 20 are supported at opposite ends of cam plate 14 and include slots 22 that are engaged by bearings 24 mounted to the inside of vertical legs 6 as best shown in FIGS. 2 and 6. The engagement of bearings 24 and slots 22 provide stability to the vertical members 20 as they are raised and lowered.

Figure 7:
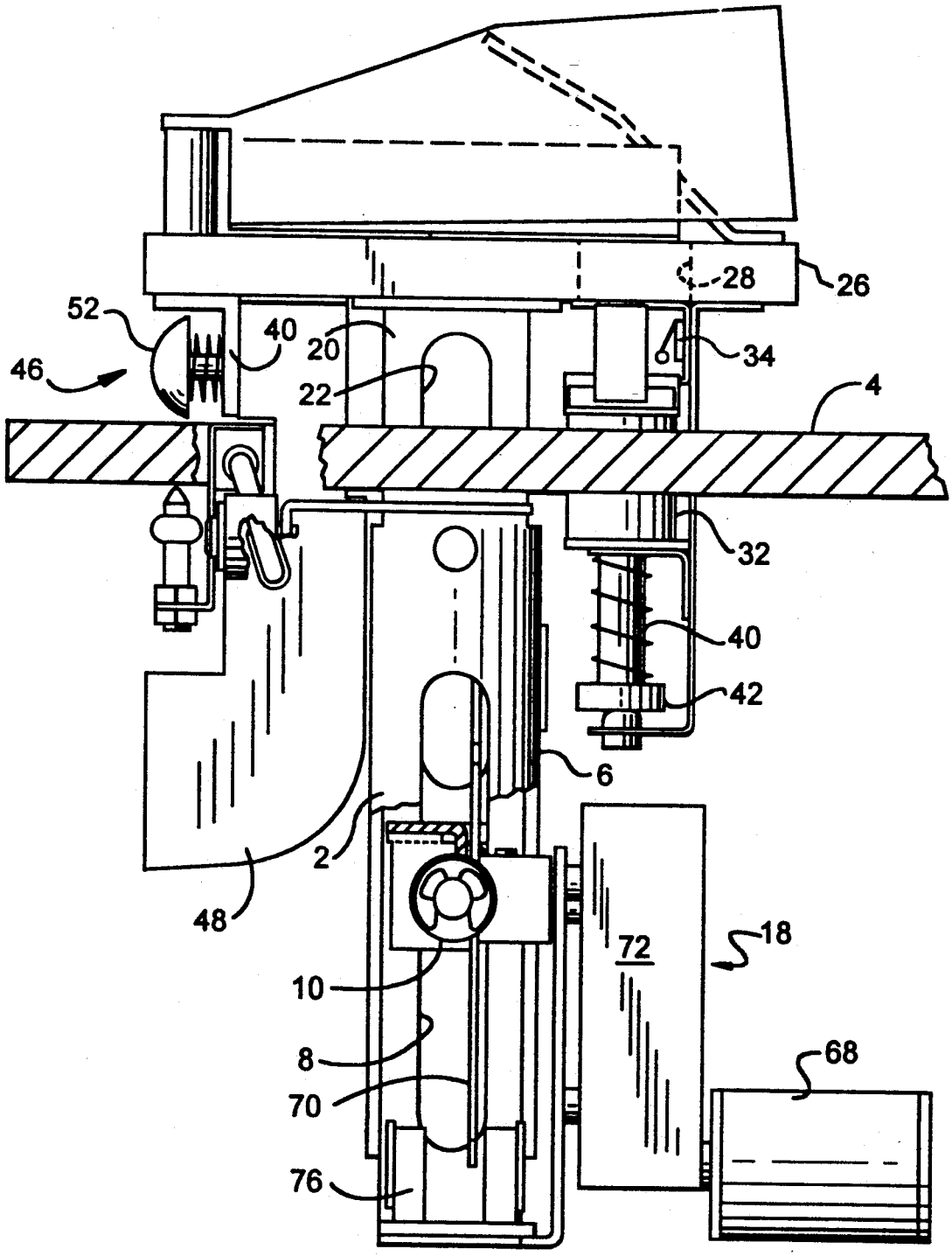
FIG. 7 is a partially cut-away side view of the play feature of the invention.

Vertical members 20 are fixed to the movable playfield section 26 by any suitable fastener such that as they are raised and lowered playfield section 26 will also be raised and lowered. The playfield section 26 includes, in a preferred embodiment, a pair of ejector holes. The ejector holes each include a hole 28 extending through playfield section 26, the holes 28 being located above the plungers 40 of solenoids 32 (FIG. 7). Suitable sensors 34 are provided to determine the presence of a ball and to provide a corresponding signal to the game's microprocessor as best shown in FIG. 7. The game's microprocessor will activate solenoid 32 as directed by the game program to cause plunger 40 to extend and eject the pinball from the ejector hole back onto the playfield. The solenoids 32 are mounted to playfield section 26 via brackets 42 such that the solenoids will move with the playfield section as it is reciprocated. While only one solenoid 32 is illustrated it will be appreciated that a solenoid is associated with each hole 28.

Extending from playfield section 26 in front of bracket 2 is a support 44 that supports the middle target bank 46 and forms the ball chutes 48 for the lower target bank 50. The middle target bank 46 includes a plurality of spring loaded button targets 52.

The lower target bank 50 includes a plurality of openings 54 defined by plate 56. A movable gate 58 is mounted at each opening such that as a ball enters the opening the gate will be moved to its open position. A ball entering one of openings 54 will fall into the corresponding chute 48 and be directed below the playfield to a ball ejector or other similar play feature from which it will be returned to the playfield.

The mechanism for supporting gates 58 will be described with particular reference to FIGS. 3–5. The gates 54 are pivotably mounted on a shaft 60 and include a protrusion 62 formed on the back thereof. Located behind each of gates 54 is a leaf spring 64. When a ball moves gate 54 to its open position, protrusion 62 flexes spring 64 and is prevented from moving relative thereto such that the gate is held in the open position. To close the gates shaft 60 is moved laterally a small distance to disengage protrusion 62 from spring 64 such that the gate will pivot about shaft 60 under the force of gravity.

To move shaft 60, a cam surface 68 (FIG. 6) is provided that is mounted to the playfield 4 or frame 2. As the play feature is moved from its upper position to its lower position the end portion 60*a* of shaft 60 will contact cam surface 68 to move shaft 60 the short distance necessary to disengage spring 64 from protrusion 62 a best shown in FIG. 6.

The mechanism for raising and lowering the play feature will now be described with reference to FIGS. 2, 6 and 7. The mechanism includes a motor 68 that drives disk 70 via gear reducer 72. Disk 70 carries cam finger 74 such that it extends into slot 16 as previously described. When motor 68 is activated, disk 70 will rotate thereby to rotate cam finger 74. As cam finger 74 rotates, it will raise and lower cam plate 14 and vertical supports 20 through its engagement with slot 16.

An optical sensor assembly 76 is provided adjacent disk 70. Disk 70 carries opto-interrupter positions 71, that correspond to the three positions of the target assembly. Optical sensor assembly 76 will provide a signal to the microprocessor corresponding to the position of the disk 70 as the opto-interrupters interrupt the sensor beam. As will be apparent the rotary position of disk 70 corresponds to the vertical position of the play feature.

In operation, the game is begun with the upper surface of the playfield section 26 even with playfield 4 such that ball ejector holes 28 are accessible to a pinball rolling on the playfield (FIG. 1). When a predetermined score pattern has been achieved by the player, for example placing a ball in one or both of the ejector holes 28, the game microprocessor will actuate motor 68 to raise frame 13 such that the middle target bank 46 is accessible to a pinball rolling on playfield 4 (FIG. 6). Sensor 76 will signal the microprocessor to deactivate motor 68 when the disk rotates to the proper position. Thus, the second level of button targets will be exposed.

When the player has again achieved a predetermined scoring goal, for example, striking each of the button targets, the microprocessor will reactivate motor 68 to raise frame 14 and expose the lower target bank 50 (FIG. 2).

Play of the game will continue until the player attains a third scoring goal, at which time motor 68 will rotate to lower the uppermost playfield section 26 back to the level of playfield 4. As the play feature is lowered, cam surface 68 will contact shaft portion 60*a* to reset the gates 54 as previously described. The balls located in ball ejector targets can then be ejected by solenoids 32 to provide multi-ball play.

While a specific construction and operation of the play feature has been described, it will be appreciated that the game microprocessor can control motor 68 to expose the targets in any sequence and to require any scoring goal for activation of motor 68. Moreover, the play feature can be used in a single ball game rather than using multi-ball play. Finally various targets can be used on the three target banks. It will be appreciated that numerous changes in the construction and operation of the invention can be made without departing from the spirit and scope of the invention as set forth in the claims.

What is claimed is:

1. A play feature for a pinball game having an inclined playfield supporting a rolling ball, comprising:

(a) a target assembly having multiple levels, said target assembly being mounted for vertical movement relative to said playfield;

(b) means for raising and lowering said target assembly to expose various ones of said multiple levels to said rolling ball; and (c) said target assembly including at least one ball ejector hole located on a first one of said multiple levels and at least one ball diverting chute located on a second one of said multiple levels.

2. The play feature according to claim 1, further including a plurality of button targets located on a third one of said multiple levels.

3. The play feature according to claim 1, further including means for determining the position of said target assembly and for generating a signal indicative of that position.

4. A play feature for a pinball game having an inclined playfield supporting plurality of other play features and a rolling ball comprising:

(a) a target assembly having a plurality of levels where each level includes a ball target movable vertically relative to the playfield to expose the ball targets on each level;

(b) means for moving said target assembly; and (c) first one of said plurality of levels including ball ejector holes and a second one of said plurality of levels including button targets

5. The play feature according to claim 4, wherein said means for moving include a rotary cam finger engageable with a cam follower mounted to said first position.

6. The play feature according to claim 4, further including sensing means for determining the position of said target assembly and for generating a signal indicative of that position.

7. The play feature according to claim 4, further including ball diverting chutes on a third one of said plurality of levels.

8. A play feature for a pinball game having an inclined playfield supporting a rolling ball, comprising:

(a) a target assembly having a plurality of levels where each level supports ball targets, said target assembly being movable relative to the playfield to expose ball targets on each level;

(b) means for moving said target assembly; and (c) a first one of said plurality of levels including at least one ball diverting chute and a second one of said plurality of levels including button targets.

9. The play feature according to claim 8, further including ball ejector holes on a third one of said plurality of levels.

* * * * *